US006273742B1

(12) United States Patent
Castagna et al.

(10) Patent No.: US 6,273,742 B1
(45) Date of Patent: Aug. 14, 2001

(54) ELECTRICAL CONNECTOR HAVING A JACK SCREW

(75) Inventors: Lou Castagna, Middletown; John Anthony Fulponi, Harrisburg, both of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/321,634

(22) Filed: May 28, 1999

Related U.S. Application Data

(60) Provisional application No. 60/087,215, filed on May 29, 1998.

(51) Int. Cl.[7] ..... H01R 13/627
(52) U.S. Cl. ..... 439/362
(58) Field of Search ..... 439/362, 364, 439/365

(56) References Cited

U.S. PATENT DOCUMENTS

| | | | | |
|---|---|---|---|---|
| 4,850,896 | * | 7/1989 | Smith et al. | 439/489 |
| 5,007,858 | | 4/1991 | Daly et al. | 439/498 |
| 5,162,000 | | 11/1992 | Frantz | 439/607 |
| 5,197,900 | | 3/1993 | Ellis et al. | 439/352 |
| 5,266,047 | | 11/1993 | Black et al. | 439/364 |
| 5,342,216 | | 8/1994 | Davis et al. | 439/362 |
| 5,647,758 | * | 7/1997 | Ichikawa et al. | 439/362 |
| 5,921,801 | * | 7/1999 | O'Sullivan et al. | 439/362 |
| 6,059,599 | * | 5/2000 | Huang | 439/362 |
| 6,095,845 | * | 8/2000 | Murphy | 439/364 |
| 6,120,332 | * | 9/2000 | Bertens et al. | 439/701 |

* cited by examiner

*Primary Examiner*—Brian Sircus
*Assistant Examiner*—Thanh-Tam Le

(57) ABSTRACT

An electrical connector (10) includes a housing having a plurality of contacts (24) mounted therein and at least one screw member (40) attached to the housing for securing the housing to a mating connector (100). The screw member (40) includes a head (42) with a ratchet (50) disposed along a forward end (48) thereof. The housing includes at least one protrusion (54) adapted to engage the ratchet (50) of the screw member. The housing further includes at least one spring member (26) adapted to provide axial compression between the ratchet (50) and the housing protrusion (54) to assure the ratchet (50) remains engaged to the protrusion (54) thereby preventing the screw member (40) from inadvertently becoming loosened.

8 Claims, 4 Drawing Sheets

ELECTRICAL CONNECTOR HAVING A JACK SCREW

This application claims the benefit of U.S. Provisional Application Ser. No. 60/087,215, filed May 29, 1998.

FIELD OF THE INVENTION

The invention is directed to an electrical connector having a jack screw locking system to maintain the electrical connector securely mated with the mating connector.

BACKGROUND OF THE INVENTION

Jack screws locking arrangements are often used to secure two mated connectors together. When such connector assemblies are subject to vibration during use, the screws can become loosened thus allowing the connectors to become separated. It is desirable, therefore, to have an assured locking system to prevent mated connectors from becoming separated when subjected to vibration and/or physical shock.

Additionally there are many electrical connector assemblies that provide float between the mating contacts. That is, the contacts are allowed to move slightly in the radial direction. The contacts are provided with float in order to adjust for differences in dimensional tolerances between the mating connectors. The float also allows the contacts to properly mate when they are not exactly aligned with each other. Some connectors also provide float in the mating direction or in the axial direction.

What is needed is an electrical connector that can be easily fastened and secured with the mating connector and not be unfastened when exposed to vibration and/or physical shock during operation, thereby providing a locking feature, but also can be unfastened with the proper tool if the need arises.

SUMMARY OF THE INVENTION

The invention is directed to an electrical connector including a housing having a plurality of contacts mounted therein and at least one screw member attached to the housing for securing the housing to a mating connector. The screw member has a threaded section to engage a complementary portion of a mating connector and to secure the housing to the mating connector upon full mating therewith. The at least one screw member further includes a head with a ratchet disposed along a forward end thereof. The housing includes at least one protrusion adapted to engage the ratchet of the at least one screw member. The housing further includes at least one spring member adapted to provide axial compression between the ratchet and the at least one housing protrusion to assure the ratchet remains engaged to the at least one protrusion thereby preventing the at least one screw member from inadvertently becoming loosened.

In one embodiment the contacts have spring members secured between the housing and the contacts to allow the contacts to move axially in the mating direction. In another embodiment a spring member is disposed on the shaft of the jack screw between the head and the leading end.

As the screw is tightened by applying a fastening torque, axial compression is provided by the contact spring members. The axial compression results in increasing frictional force at the ratchet of the screw head, which the user must overcome by applying added torque, until the screw bottoms on a physical stop and the applied torque is removed. The screw is now locked in the fastened position. In order to unfasten the screw, the user must break the lock by applying sufficient unfastening torque to overcome the frictional force at the ratchet. The screw is much less susceptible to unfastening during shock and vibration of normal use since the torque required for unfastening is not likely to be generated by normal shock and vibration.

BRIEF DESCRIPTION OF THE DRAWINGS

Embodiments of the invention will now be described with reference to the accompanying drawings, in which.

DETAILED DESCRIPTION OF THE DRAWINGS

Figure 1:
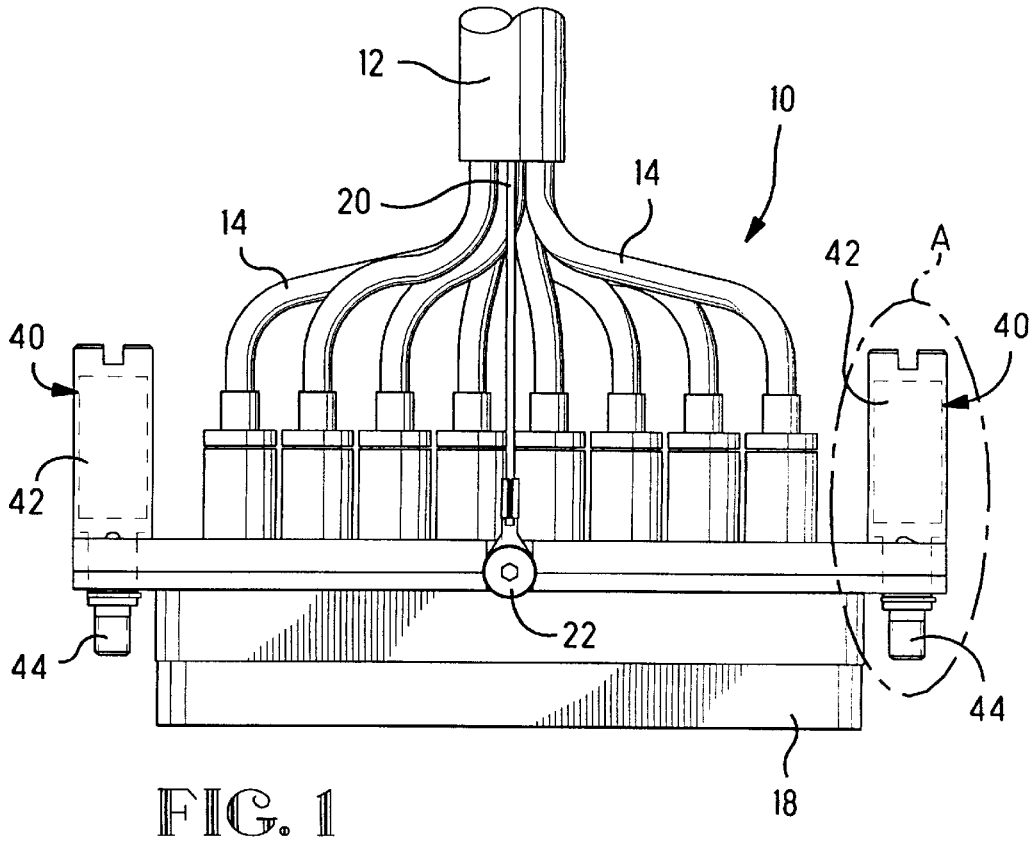
FIG. 1 is a plan view of an electrical connector made in accordance with the present invention.
Figure 2:
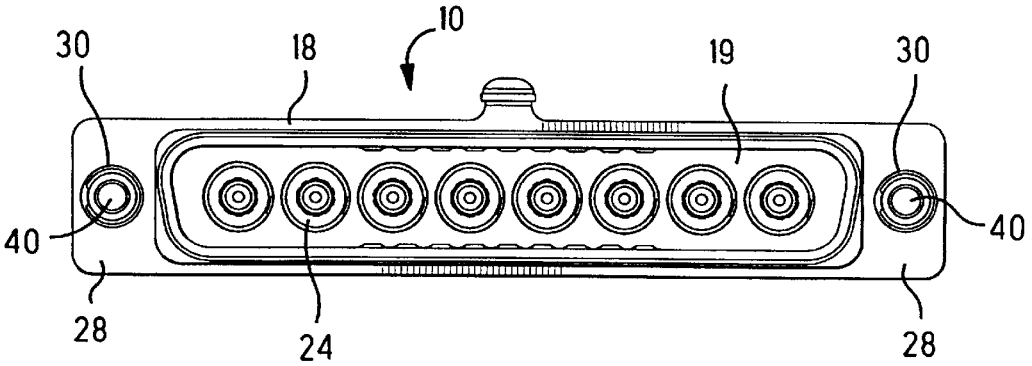
FIG. 2 is a front view of the electrical connector of FIG. 1.

FIG. 1 shows a side view of the electrical connector 10. While a specific design of the connector is shown, it is to be understood that the electrical connector 10 could be designed in a number of configurations.

The electrical connector 10 is terminated to a multiconductor cable 12. The multiconductor cable 12 has a plurality of wires 14 and a ground wire 20 extending therefrom. The wires 14 are terminated to contacts 24 that are disposed within the connector 10, see FIG. 3. The electrical connector 10 has a shroud 18 that can be metallic to provide grounding or shielding of the electrical connector. On the interior of the shroud 18 is a dielectric insert 19 into which the contacts 24 are secured.

The shroud 18 has a flange 28 that extends around the periphery of the electrical connector 10. The flange 28 has two mounting holes 30 on either side of the electrical connector.

Mounted within the mounting holes 30 are jack screws 40. The jack screws 40 each have a head 42 to receive a screw driver or to be twisted by the operator's fingers or by some other tool. The jack screw has a threaded portion 44 that extends along the front of the flange 28 to engage the mating connector 100.

Figure 3:
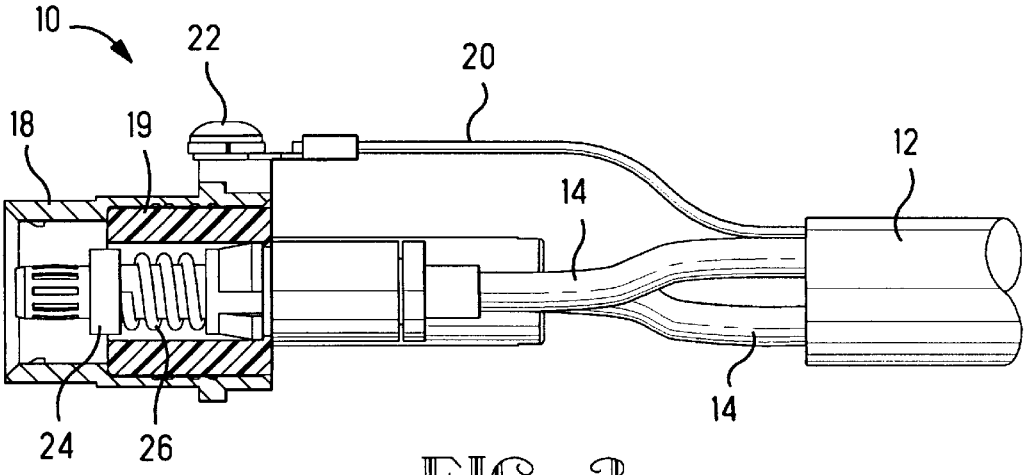
FIG. 3 is a cross-sectional view of the electrical connector of FIG. 1.

As can be seen from FIG. 3, the contacts 24 are mounted within the electrical connector 10 with a degree of float. That is, the contacts 24 are able to move radially. The contacts 24 are spring biased within the housing of the electrical connector 10 by way of spring members 26. The spring members 26 bias the contacts 24 forwardly and also allow the contacts 24 to move radially. The spring members 26 will also allow the contacts 24 to move forwardly and backwardly, that is axially in the mating direction.

During mating with a contact in the mating connector 100 (the contact in the mating connector is not shown but would typically be a pin contact) the contact 24 is pushed rearwardly by the force of the mating contact. Once the mating contact pin is received within the receptacle end of the contact 24, as the connectors 10, 100 are pushed more closely together, the contacts 24 continue to exert a force against the mating contact.

Figure 5:
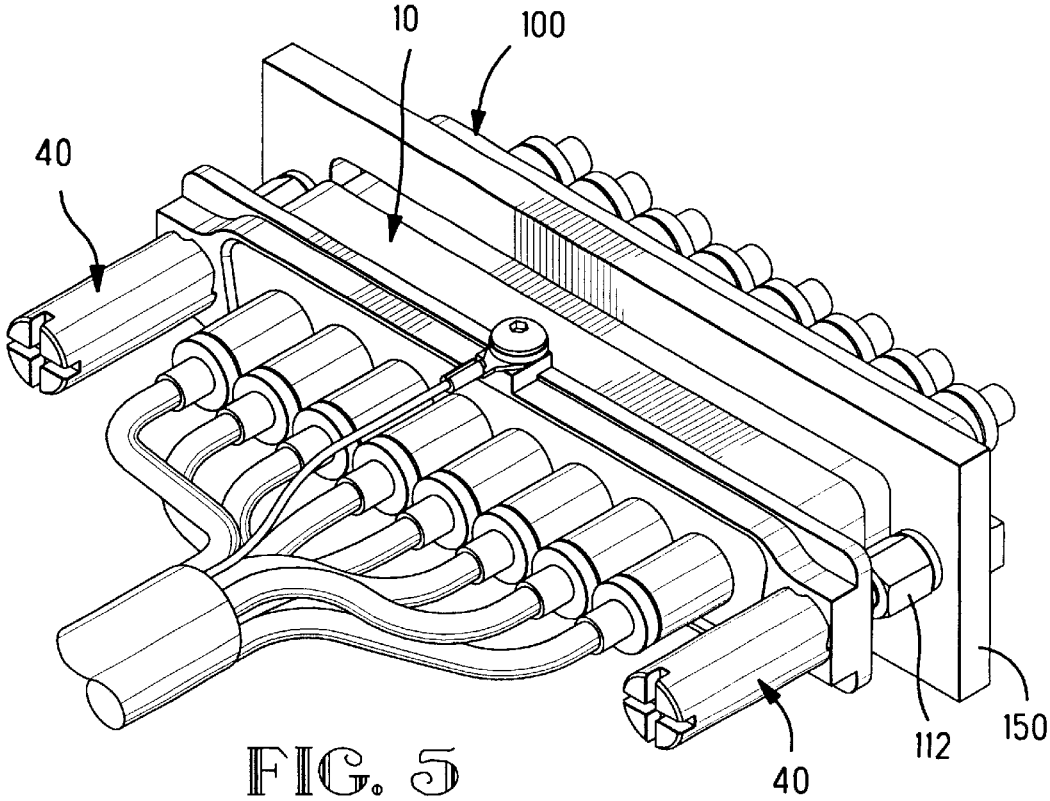
FIG. 5 is an isometric view of the electrical connector of FIG. 1 mated with a mating connector.

FIG. 5 shows the electrical connector 10 mated with the mating connector 100. The mating connector 100 has a shroud 102 that surrounds a housing, not shown, with a plurality of pin contacts, not shown, mounted within the housing (not shown). The connector 100 has two locking nuts 112 on either end of the mating connector 100. The locking nuts 112 have a threaded interior in order to engage the threaded end 44 of the jack screw 40. The mating connector 100 is mounted to a panel 150.

When the electrical connector 10 and the mating connector 100 are brought together, the shrouds 18, 102 engage each other to provide a common ground between the two connectors 10, 100. Furthermore, the pin contacts will come into contact with the receptacle contacts 24. The jack screw 40 is used to secure the connectors 10, 100 together.

As the connectors 10, 100 are mated together, the pin contacts will engage the receptacle contacts 24 in the electrical connector 10. The force of the mating between the contacts 24 causes the spring member 26 to be compressed. When the connectors 10, 100 are fully mated, it is necessary for the jack screw 40 to be able to accommodate the extra forces exerted on the connectors 10, 100 because of the float built into the contacts 24, that is, the forces due to the spring connection between the electrical connector 10 and the contacts 24. The interaction between the threaded end 44 of the jack screw 40 and the locking nut 112 on the mating connector 100 will serve to pull and secure the two connectors 10, 100 together.

Figure 4:
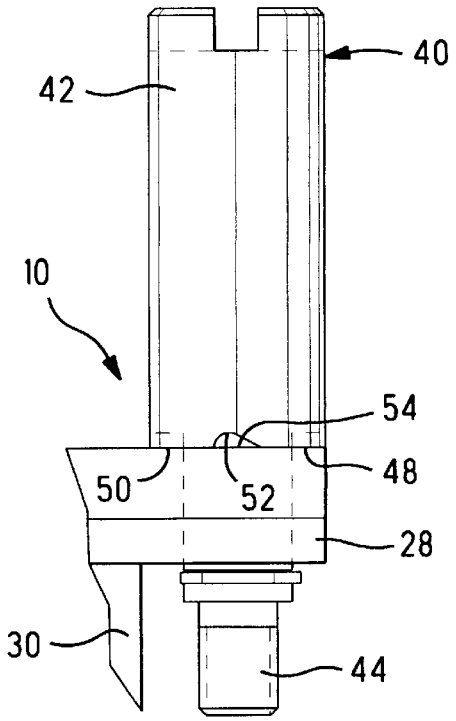
FIG. 4 is an enlarged view of the jack screw of the present invention as defined by portion A.
Figure 6:
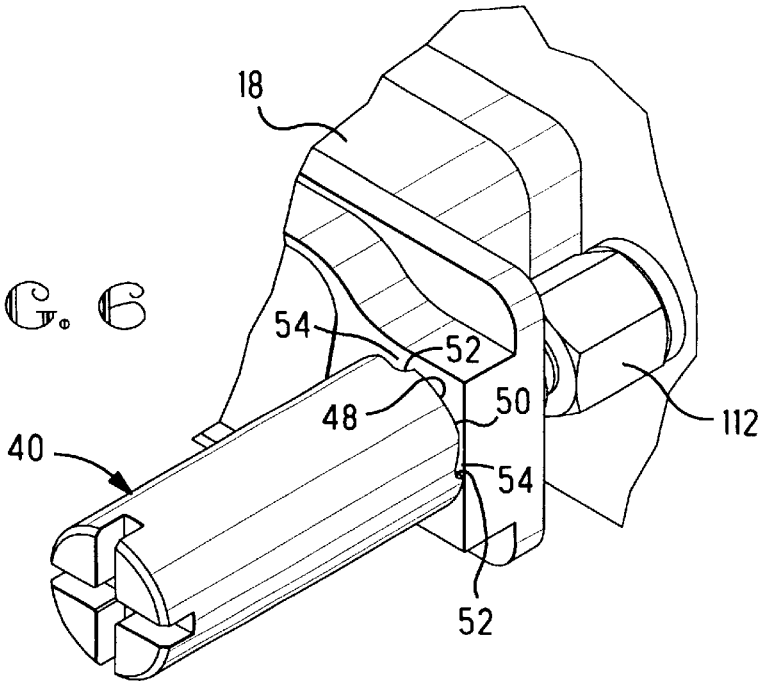
FIG. 6 is an enlarged view of the jack screw engaging the mating connector.

When the mated connector assembly experiences vibration and/or physical shock, the extra forces on the mated connectors 10, 100 may cause the jack screw 40 to become loosened. In order to prevent this, the jack screw 40 has a ratchet head 50 on the forward end 48 of the head of the jack screw 40. The ratchet head 50 includes a series grooves 52 having a semi-circular half moon shape 53 that extend along the forward end 48 of the head 42, as shown in FIGS. 4 and 6. In addition, the flange 28 has a series of protrusions 54 that complement the half moon shaped grooves 52. In the example shown, there are four each of the grooves 52 and the protrusions 54, and they are distributed equally around the forward end 48 of the head of the jack screw 40 and on the flange 28. There could be other numbers of grooves and protrusions, preferably being distributed equally about the forward head of the jack screw and the flange.

As the connectors 10, 100 are brought together, the force between the pin contacts (not shown) and the spring mounted contacts 24 will tend to push backwards on the connector 10 away from the mating connector. Therefore, as the threaded portion 44 of the jack screw 40 engages the locking nut 112 on the connector 100, the connector 10 will tend to be pushed backwards, away from the mating connector. The flange 28 will be pushed against the forward end 48 of the jackscrew 40 and the protrusions 54 will rest in the grooves 52. As the jackscrew 40 is turned, the grooves 52 will rotate from one protrusion 54 to the next in a ratcheting motion. After each quarter turn, the force pushing the connector 10 backwards will push the protrusion 54 into the associated groove 52. When the connectors 10, 100 are secured together as tightly as necessary, the interaction between the protrusions 54 and the grooves 52 will prevent the jack screw 40 from turning on its own and therefore loosening. During vibration and/or physical shock, the jack screw 40 will remain in the position in which it was placed, thereby maintaining the forces between the electrical connectors 10, 100. The positioning of the jack screw is maintained because of the axial compression placed on the jack screw 40 through the ratchet, or the grooves 52 and protrusion 54, on the forward end 48 of the jack screw 40.

During mating of the connectors 10, 100, the grooves 52 will engage the protrusions 54. As the jack screw 40 is turned, the forward end 48 of the head 42 will push on the protrusions 54 thereby pushing the connector 10 forwardly towards the mating connector 100. The force of the connector 10 being pushed forwardly will be transmitted to the contacts 24 and to the spring members 26 disposed around the contacts 24. As the connector 10 is pushed forwardly, the contacts 24 will engage the mating contacts and will be pushed backward against the spring members 26. Also, the force of the spring members 26 pushing the contacts 24 forward is translated to a backward force on the connector 10 against the jack screw 40. This distribution of forces allows the jack screw 40 to work with the ratchet in order to first secure the connectors 10, 100 together and then keep them secured together by preventing the jack screw 40 from becoming loosened.

Figure 7:
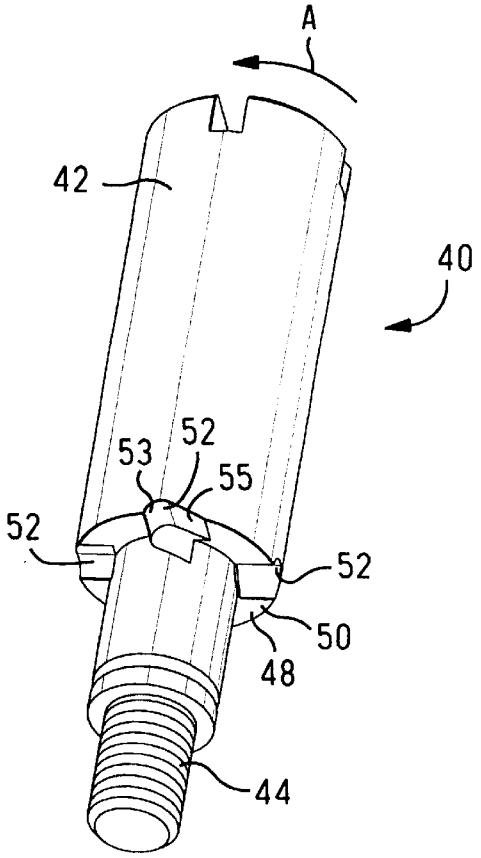
FIG. 7 is an enlarged view of an alternative embodiment of a jack screw made in accordance with the invention.

FIG. 7 shows an alternative embodiment of the jack screw 40, in which like features will have the same reference numerals. Jack screw 40 has a head 42 and a threaded section 44 and is secured to the electrical connector 10 in a similar manner as described earlier. Jack screw 40 has a forward end 48 with a ratchet head 50. The ratchet head 50 has a series of grooves 52 to engage the protrusions 54 on the electrical connector 10. The grooves 52 are shaped differently than described earlier. One side of the groove 52 has the same semi-circular shape 53 as described earlier, the other side of the groove has a longer, ramped surface 55 which slopes toward the forward end 48.

As the jack screw 40 is tightened, or turned in the direction indicated by arrow A in FIG. 7, the protrusions 54 on the connector 10 will ride along the ramped surface 55 until it reaches the forward end 48. At this point, the protrusion will easily move along the surface of the forward end. It takes less torque to move the jack screw 40 such that the protrusions 54 are removed from the grooves 52 shown in FIG. 7 than it does to perform the same function on the jack screw shown in FIGS. 1–6, while maintaining the same locking force. FIG. 7 shows an alternative embodiment of the jack screw, but either of the embodiments shown can be used in the invention.

Figure 8:
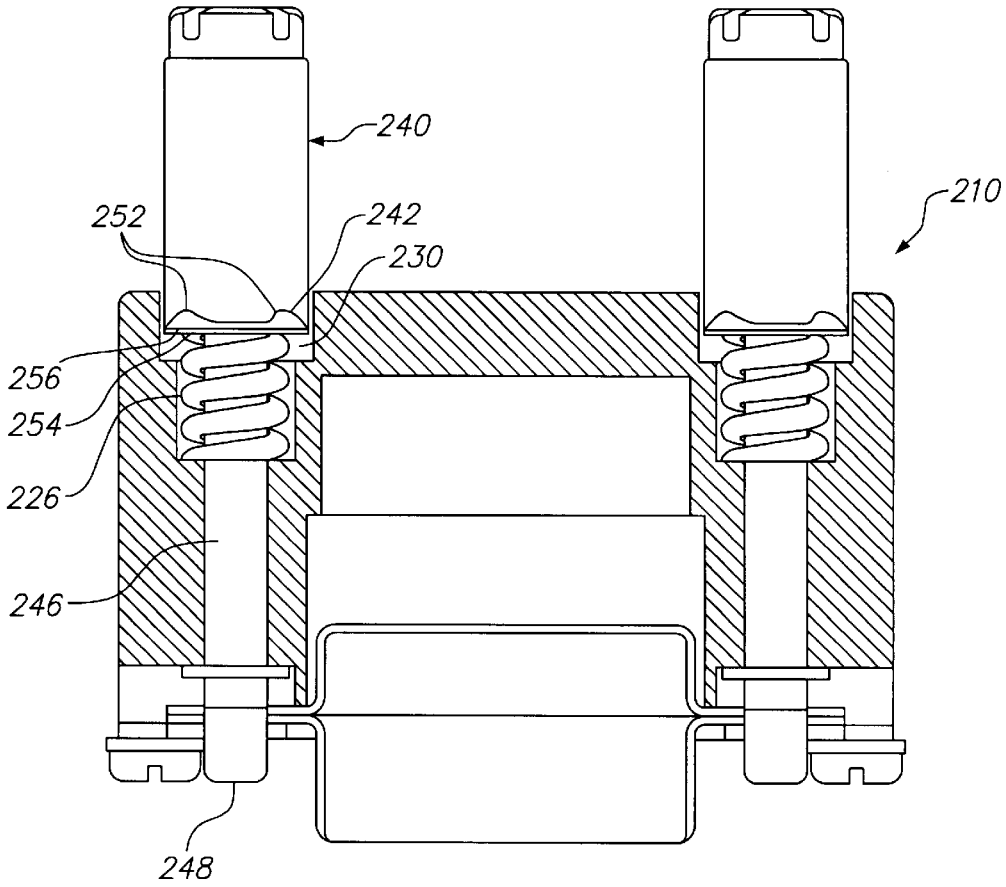
FIG. 8 is a partially sectioned plan view of an electrical connector using a further alternative embodiment of the present invention.

FIG. 8 illustrates a further embodiment 210 of the connector in which spring members 226 are disposed on the shaft 246 of jack screws 240, between the head 242 and forward end 248. The jack screws 240 are disposed in passageways 230 that are configured to provide a portion for the spring members 226 and the heads 242. In this embodiment each housing passageway 230 also includes a plate 256 having a plurality of protrusions 254 that engage grooves 252 on a corresponding head 242. The plate 256 may be made of stainless steel or the like and moves downwardly within passageway 230 as the jack screw is secured to the mating connector (not shown). As the mating connectors are brought together, the compressive force exerted by the spring member against the head of the jack screw and plate assure that the jack screw is locked into position and the assembly will be locked together in the manner previously described. In this embodiment, it is only necessary for the jack screws to have spring members. It is to be understood that this jack screw embodiment may be used with connectors having other configurations and with or without spring loaded contacts.

An advantage of the embodiments shown is that the electrical connectors will remain securely attached to each other even when the connector assembly is subjected to stresses from vibration or physical shock. Furthermore, in the embodiment of FIGS. 1 through 7, the jack screw will counterbalance the forces due to the float built into the contacts. The ratchet head provides a locking feature to the jack screw.

It is thought that the electrical connector of the present invention and many of its intended advantages will be understood from the foregoing description. It is apparent that various changes may be made in the form, construction, and arrangement of parts thereof, without departing from the spirit or scope of the invention without sacrificing all of its material advantages.

What is claimed is:

1. An electrical connecor comprising:

a housing having a plurality of contacts mounted therein;

at least one screw member attached to the housing, the screw member having a threaded section to engage a complementary portion of a mating connector and to secure the housing to the mating connector upon full mating therewith;

the at least one screw member further including a head with a ratchet disposed along a forward end thereof;

the housing including at least one protrusion adapted to engage the ratchet of the at least one screw member;

at least one spring member adapted to provide axial compression between the ratchet and the at least one housing protrusion to assure the ratchet remains engaged to the at least one protrusion thereby preventing the at least one screw member from inadvertently becoming loosened; and a plurality of second spring members, each of the plurality of second spring members being associated with a respective one of the contacts such that the contacts are at least axially floatable.

2. The electrical connector of claim 1 wherein the ratchet includes a plurality of grooves adapted to engage the at least one protrusion.

3. The electrical connector of claim 2 wherein the housing includes a plurality of protrusions adapted to engage a plurality of the grooves.

4. The electrical connector of claim 1 wherein the housing includes a plurality of protrusions adapted to engage a plurality of complementary surfaces on the ratchet.

5. The electrical connector of claim 1 wherein the at least one spring member is disposed on the at least one screw member.

6. The electrical connector of claim 1 further including a pair of screw members, at least one of the pair having the spring member disposed thereon.

7. The electrical connector of claim 1 including a pair of screw members and a pair of spring members, each spring member being disposed on a respective one of the screw members.

8. The electrical connector of claim 5 wherein the housing further includes a plate disposed in each screw-receiving aperture, the plate including at least one protrusion thereon for engaging a complementary surface of the ratchet.

* * * * *